US007607599B2

(12) United States Patent
Jara-Almonte et al.

(10) Patent No.: US 7,607,599 B2
(45) Date of Patent: Oct. 27, 2009

(54) FOOD WASTE REDUCTION MECHANISM FOR DISPOSER

(75) Inventors: Cynthia C Jara-Almonte, Kenosha, WI (US); Steven P Hanson, Racine, WI (US)

(73) Assignee: Emerson Electric Co., St. Louis, MO (US)

( * ) Notice: Subject to any disclaimer, the term of this patent is extended or adjusted under 35 U.S.C. 154(b) by 225 days.

(21) Appl. No.: 10/859,895

(22) Filed: Jun. 3, 2004

(65) Prior Publication Data

US 2004/0245358 A1 Dec. 9, 2004

Related U.S. Application Data

(60) Provisional application No. 60/476,386, filed on Jun. 6, 2003.

(51) Int. Cl.
*B02C 17/02* (2006.01)
*B07B 13/00* (2006.01)

(52) U.S. Cl. ..... 241/92; 241/46.015; 241/46.016

(58) Field of Classification Search ..... 241/92, 241/46.014, 46.015, 46.016, 194, 94
See application file for complete search history.

(56) References Cited

U.S. PATENT DOCUMENTS

| | | | | |
|---|---|---|---|---|
| 1,174,656 | A | 3/1916 | Beckwith | |
| 1,459,713 | A | 6/1923 | Beggs | |
| 1,965,033 | A | 7/1934 | Dillon | |
| 2,004,737 | A | 6/1935 | Tonks | |
| 2,012,680 | A | 8/1935 | Hammes | |
| 2,044,563 | A | 6/1936 | Carter | |
| 2,044,564 | A | 6/1936 | Carter | |
| 2,225,171 | A | 12/1940 | Hammes | |
| 2,829,838 | A * | 4/1958 | Macemon | 241/46.08 |
| 2,933,964 | A * | 4/1960 | Wittlin | 81/119 |
| 2,940,677 | A * | 6/1960 | Jordan | 241/46.014 |
| 3,025,117 | A | 3/1962 | Weiczorek | 241/100.5 |

(Continued)

FOREIGN PATENT DOCUMENTS

GB 630 494 A 10/1949

(Continued)

OTHER PUBLICATIONS

2 Photographs of Grinding Plate by In-Sink-Erator available from about 1960 (Top View and Bottom View), 2-pages.

(Continued)

*Primary Examiner*—Bena Miller
(74) *Attorney, Agent, or Firm*—Harness, Dickey & Pierce, P.L.C.

(57) ABSTRACT

Various mechanisms for reducing food waste in a food waste disposer are disclosed. In each of the reduction mechanisms, structures are provided for shearing food waste as it passes through or past a rotating shredder plate of the disposer. Each of the reduction mechanism has a rotatable plate having a plurality of lugs positioned for rotation relative to an inner wall of a stationary ring. In one embodiment, the reduction mechanism includes a horizontal toothed ledge positioned above the stationary ring is used to enhance grinding the food waste. In another embodiment, the reduction mechanism includes a vertical rasping surface positioned above the stationary ring. In yet another embodiment, the reduction mechanism includes serrated edges added to the vertical leading edges of the teeth on the stationary ring.

16 Claims, 4 Drawing Sheets

U.S. PATENT DOCUMENTS

| | | | | | |
|---|---|---|---|---|---|
| 3,026,050 | A | | 3/1962 | Bebinger | |
| 3,113,735 | A | * | 12/1963 | Clements | 241/46.013 |
| 3,211,389 | A | | 10/1965 | Sherman, Jr. | |
| 3,236,462 | A | * | 2/1966 | Stout | 241/46.016 |
| 3,335,970 | A | * | 8/1967 | Hardy | 241/188.1 |
| 3,589,624 | A | | 6/1971 | Smith | 241/46.08 |
| 3,804,341 | A | | 4/1974 | Guth | 241/32.5 |
| 3,862,720 | A | | 1/1975 | Guth | 241/100.5 |
| 3,875,462 | A | | 4/1975 | Keifer et al. | 371/13 R |
| 4,128,210 | A | | 12/1978 | Brenner et al. | 241/46 R |
| 4,134,555 | A | | 1/1979 | Rosselet | 241/46 B |
| 4,183,470 | A | | 1/1980 | Englel et al. | |
| 4,573,642 | A | | 3/1986 | Spelber | 241/46 B |
| 4,776,523 | A | | 10/1988 | Hurst | 241/46 B |
| 4,917,311 | A | | 4/1990 | Yoshino et al. | 241/36 |
| 5,129,590 | A | | 7/1992 | Shinya | 241/46.013 |
| 5,340,036 | A | | 8/1994 | Riley | 241/56 |
| 5,533,681 | A | | 7/1996 | Riley | 241/56 |
| 6,007,006 | A | | 12/1999 | Engel et al. | 241/46.014 |
| D436,496 | S | | 1/2001 | Anderson et al. | D7/375 |
| 6,439,487 | B1 | | 8/2002 | Anderson et al. | 241/46.013 |
| 6,481,652 | B2 | | 11/2002 | Strutz et al. | 241/46.013 |

FOREIGN PATENT DOCUMENTS

| | | | |
|---|---|---|---|
| GB | 719 509 | A | 12/1954 |
| GB | 771 419 | A | 4/1957 |
| GB | 880 821 | A | 10/1961 |
| GB | 1 308 229 | A | 2/1973 |

OTHER PUBLICATIONS

2 Photographs of Grinding Plate by In-Sink-Erator available from about 1968 (Top View and Bottom View), 2-pages.

2 Photographs of Grinding Plate by In-Sink-Erator available from about 1970 (Top View and Bottom View) , 2-pages.

* cited by examiner

FOOD WASTE REDUCTION MECHANISM FOR DISPOSER

CROSS REFERENCE TO RELATED APPLICATIONS

This application claims the benefit of the U.S. Provisional Application Ser. No. 60/476,386 filed Jun. 6, 2003.

FIELD OF THE INVENTION

The present invention relates generally to a food waste disposer and more particularly to a mechanism for reducing food waste in a disposer.

BACKGROUND OF THE INVENTION

In designing a mechanism for reducing food waste in a food waste disposer, consideration must be paid to the speed with which a reduction operation is completed and the resulting size of particulate matter produced during the reduction operation. A manufacturer must also consider the demands that a wide variety of food waste with varying properties (i.e., soft, hard, fibrous, stringy, leafy, elastic, and resilient) may have on a reduction mechanism in the disposer. Due to healthier diets, for example, consumers tend to eat more fruits and vegetables, resulting in food waste having a soft, stringy, leafy, or resilient consistency. Additionally, the modem diet has increased in consumption of white meat. The waste from meat typically includes bone. Although the bones from white meat are typically not as durable or difficult to grind compared to bones from red meat, the bones from white meat tend to splinter. In addition, the waste from white meat typically includes skin, which is elastic and resilient.

A number of mechanisms for reducing food waste in a food waste disposer are used in the art. One example of a mechanism of the prior art is used in the General Electric Model GFC 700Y Household Disposer manufactured by Watertown Industries. Other examples of mechanisms of the prior art are disclosed in U.S. Pat. Nos. 6,007,006 to Engel et al. and 6,439,487 to Anderson et al., which are owned by the assignee of record and are incorporated herein by reference in their entireties. In the prior art disposers of the '006 and '487 patents, a rotatable plate is connected to a motor and has lugs attached to the plate. A stationary ring is attached to the housing of the disposer and is positioned vertically about the periphery of the rotatable plate. During operation of the prior art mechanisms, food waste is delivered to the rotatable plate, and the lugs force the food waste against the stationary ring. Teeth on the stationary ring grind the food waste into particulate matter sufficiently small enough to pass from above the rotatable plate to below the plate via spaces between the teeth and the periphery of the rotatable plate. The particulate matter then passes to a discharge outlet of the disposer.

While mechanisms of the prior art disposer are satisfactory for reducing food waste in most applications, designers of food waste disposers continually strive to design and manufacture mechanisms capable of adequately reducing a number of types of food waste that may be encountered by the disposer. Current designs of reduction mechanisms in disposers may encounter some difficulty in sufficiently reducing fibrous, stringy, or elastic food waste, such as cornhusks, artichokes, parsley stems, poultry bones, and poultry skin, for example. Such food waste may pass though the radial spaces between the rotatable plate and stationary ring without being adequately reduced in size. Consequently, the passed fibrous or stringy food waste may create blockages in the disposer discharge or in the household plumbing. Moreover, such semi-reduced fibrous waste is prone to lingering in the disposer instead of being washed away in the plumbing, which can cause foul odors from the disposer. It is presently not recommended by food waste disposer manufacturers to dispose of highly fibrous food waste such as corn husks or artichoke leaves in a food waste disposer, and in fact instructions that currently accompany the sale of a food waste disposer typically make this point explicit.

The art has thus long searched for solution to remediate the problems presented by the inadequate reduction of fibrous food wastes in a food waste disposer. If a food waste disposer grinding system could completely grind and suitably discharge such fibrous materials, the consumer would no longer have to be concerned about putting inappropriate items in the disposer. The present invention is directed to overcoming, or at least reducing the effects of, one or more of the problems set forth above.

SUMMARY OF THE PRESENT DISCLOSURE

Various mechanisms for reducing food waste in a food waste disposer are disclosed. In each of the reduction mechanisms, structures are provided for shearing food waste as it passes through or past a rotating shredder plate of the disposer. In each of the disclosed embodiments, a rotatable plate is coupled to a shaft of a motor housed in the disposer. A stationary ring is disposed in the disposer and has an inner wall disposed about the rotatable plate. The rotatable plate has a central portion coupled to the motor shaft and has a peripheral portion disposed adjacent the stationary ring. Movable lugs can be attached to the rotatable plate and capable of swiveling and sliding relative to the rotatable plate. Alternatively, fixed lugs can also be attached to the rotatable plate. Moreover, a combination of fixed and movable lugs can be used on the rotatable plate.

In one embodiment of the present invention, a horizontal toothed ledge having horizontal teeth is positioned directly above the stationary ring and is provided to enhance grinding of the food waste. In another embodiment of the present invention, a horizontal toothed ledge having alternating horizontal teeth and vertically-oriented downward teeth is provided to enhance grinding of the food waste. In yet another embodiment of the present invention, a vertical grating or rasping surface is positioned directly above or is incorporated in the stationary ring and is provided to enhance grinding of the food waste. In yet another embodiment, serrated edges are incorporated on the leading vertical edge of each tooth in the stationary ring and are provided to enhance grinding of the food waste.

BRIEF DESCRIPTION OF THE DRAWINGS

The foregoing summary, preferred embodiments, and other aspects of the inventive concepts will be best understood with reference to a detailed description of specific embodiments, which follows, when read in conjunction with the accompanying drawings, in which.

DETAILED DESCRIPTION

Figure 1A:
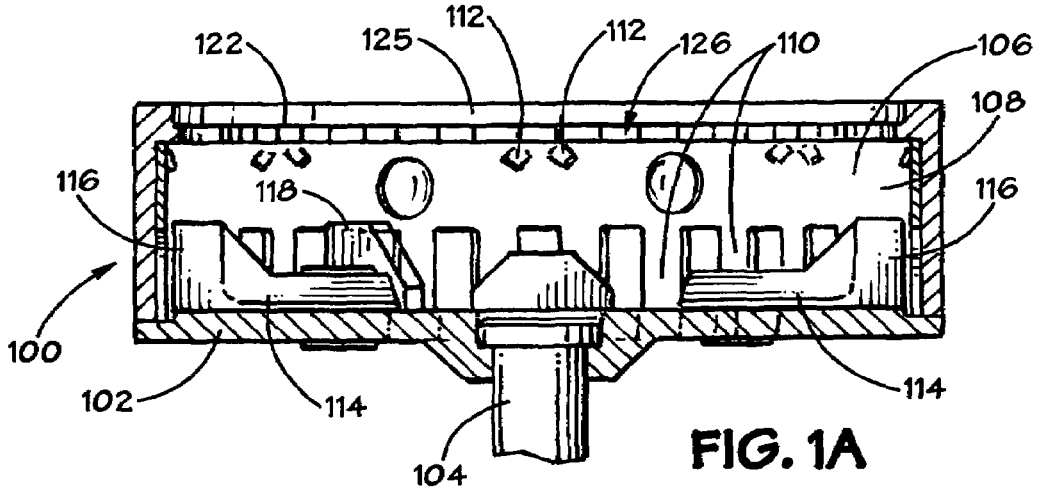
FIGS. 1A-1C illustrate various views of a food reducing mechanism which includes a horizontal toothed ledge working surface having horizontal teeth.

Disclosed herein are improved food reduction mechanisms for a food waste disposer. These disclosed mechanisms are alternative or supplementary to those mechanisms disclosed in U.S. patent application Ser. No. 10/790,311, entitled "Food Waste Reduction Mechanism For Disposer," filed Mar. 3, 2004, which is incorporated herein by reference in its entirety.

In the interest of clarity, not all features of actual implementations of a reduction mechanism for a food waste disposer are described in the disclosure that follows. It will of course be appreciated that in the development of any such actual implementation, as in any such project, numerous engineering and design decisions must be made to achieve the developers' specific goals, e.g., compliance with mechanical and business related constraints, which will vary from one implementation to another. While attention must necessarily be paid to proper engineering and design practices for the environment in question, it should be appreciated that the development of a reduction mechanism would nevertheless be a routine undertaking for those of skill in the art given the details provided by this disclosure.

In each of the embodiments and figures disclosed herein, a rotatable plate 102 is coupled to a shaft 104 of a motor (not shown) housed in the disposer (not shown). A stationary ring 106 is disposed in the disposer and has an inner wall 108 disposed about the circumference of the rotatable plate 102. The inner wall 108 is preferably substantially vertical with respect to the horizontal plane of the rotatable plate 102. As noted in U.S. patent application Ser. No. 10/790,311 incorporated above, several techniques known in the art can be used to fixedly mount the stationary ring 106 in the housing of the disposer. The stationary ring 106 is preferably composed of stainless steel, but alternatively may be composed of Ni-Hard. The inner wall 108 of the stationary ring 106 defines lower teeth 110 and breakers or diverters 112. The lower teeth 110 are positioned adjacent the rotatable plate 102 and the location where the weighted ends 116 of the movable lugs 114 pass when the disposer is operated. The lower teeth 110 are used as a grinding surface for food waste impacted and moved thereon as the lugs 114/118 and rotatable plate 102 are rotated during operation. The breakers or diverters 112 are preferably provided as inwardly projecting tabs, but also may also be provided as inwardly projecting splines. It is envisioned that other techniques and methods can be used for the construction of the stationary ring 106 and its features. For example, details of stationary rings that can be used with the disclosed reduction mechanisms are disclosed in U.S. Pat. Nos. 6,007,006 and 6,439,487, which are incorporated herein by reference in their entirety.

One or more movable lugs 114 are attached to the peripheral portion of the rotatable plate 102 and have weighted ends 116 for passing adjacent the stationary ring 106 for shearing the food waste during operation. Preferably, two movable lugs 114 are used. The movable lugs 114 can be movably attached to the rotatable plate 102 and capable of swiveling and sliding relative to the rotatable plate 102. Fixed lugs 118 can also be attached to rotatable plate 102. At least some of the fixed lugs 118 preferably have ends 120 that pass adjacent the inner wall 108. Interaction between the fixed lugs 118 and the stationary ring 106 produce shearing or cutting forces for reducing the food waste. Preferably, as shown in FIGS. 1-4, a combination of fixed lugs 118 and movable lugs 114 can be used on the rotatable plate 102. Preferably, the lugs 118/114 used in the disclosed embodiments herein are forged, cast, or machined and have substantially sharp edges.

As the rotatable plate 102 is rotated, friable food waste can be reduced to smaller particles by the mere impacts with the rotatable plate 102, lugs 118/114, and inner wall 108. The food waste is also reduced to smaller particles by the grinding forces or frictional interaction between the weighted ends 116 of the movable lugs 114 or the ends 120 of the fixed lugs 118 and the inner wall 108 with teeth 110 of the stationary ring 106.

Figure 1B:
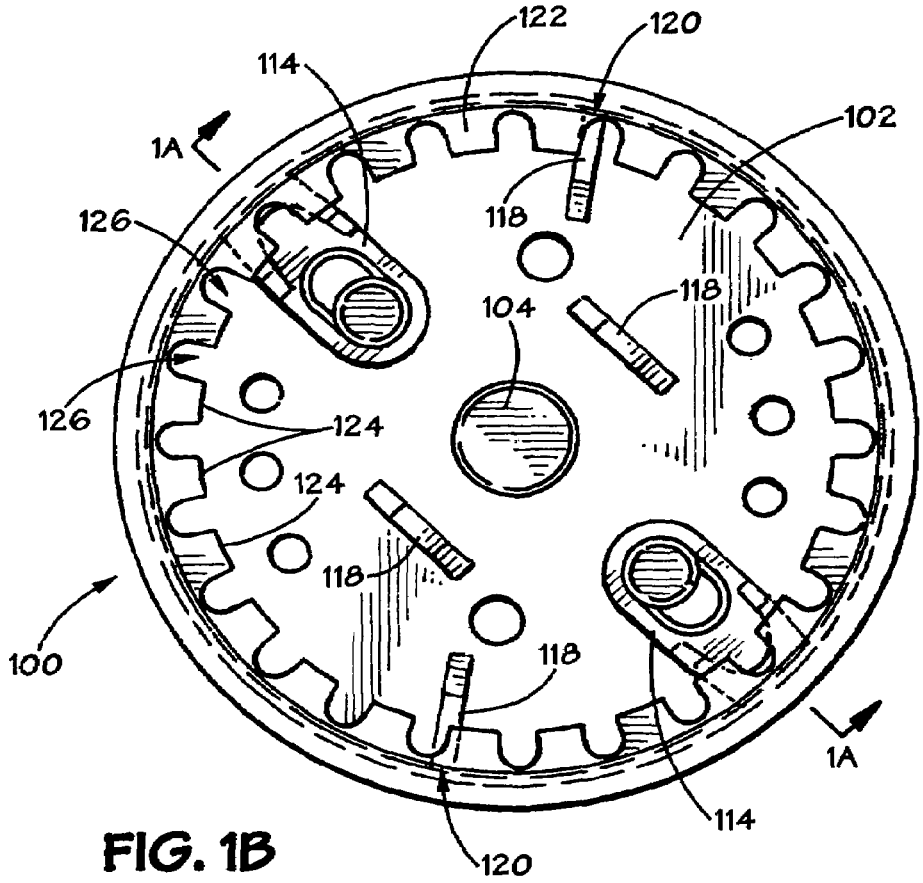
Figure 1C:
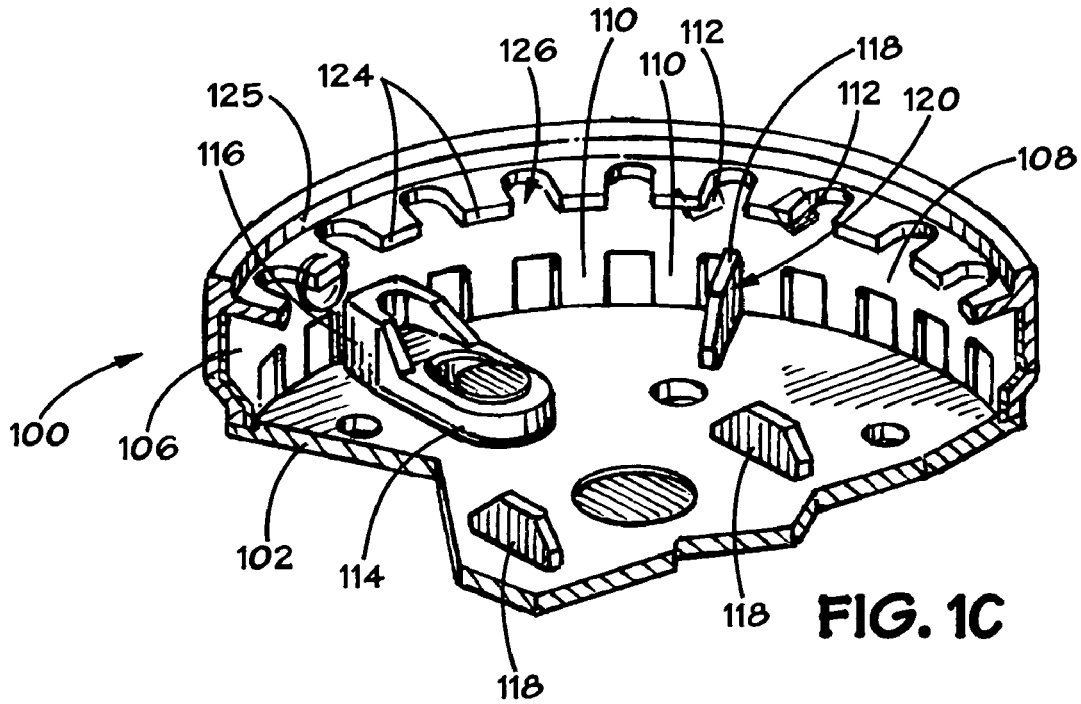

It has been found that adding a working surface above the existing stationary shredder ring 106 is very effective in more completely grinding and discharging even fibrous material such as corn husks and artichoke leaves, and is particularly effective when used in conjunction with a combination of fixed lugs 118 and rotatable lugs 114. Referring specifically to FIGS. 1A-1C, an embodiment of a reduction mechanism 100 having a horizontal toothed ledge 122 working surface having horizontal teeth 124 is illustrated. FIG. 1A shows the reduction mechanism 100 in side cross-section, FIG. 1B shows the reduction mechanism 100 in a top view, and FIG. 1C shows the reduction mechanism 100 in a perspective view. The horizontal toothed ledge 122 is positioned directly above the stationary shredder ring 106 in a plastic adaptor 125 that can be directly inserted into the disposal grind chamber. The preferred embodiment of horizontal toothed ledge 122, as best shown in FIG. 1B, comprises a flat ring formed with twenty-four equally spaced truncated teeth 124 separated by semicircular openings 126.

Figure 2C:
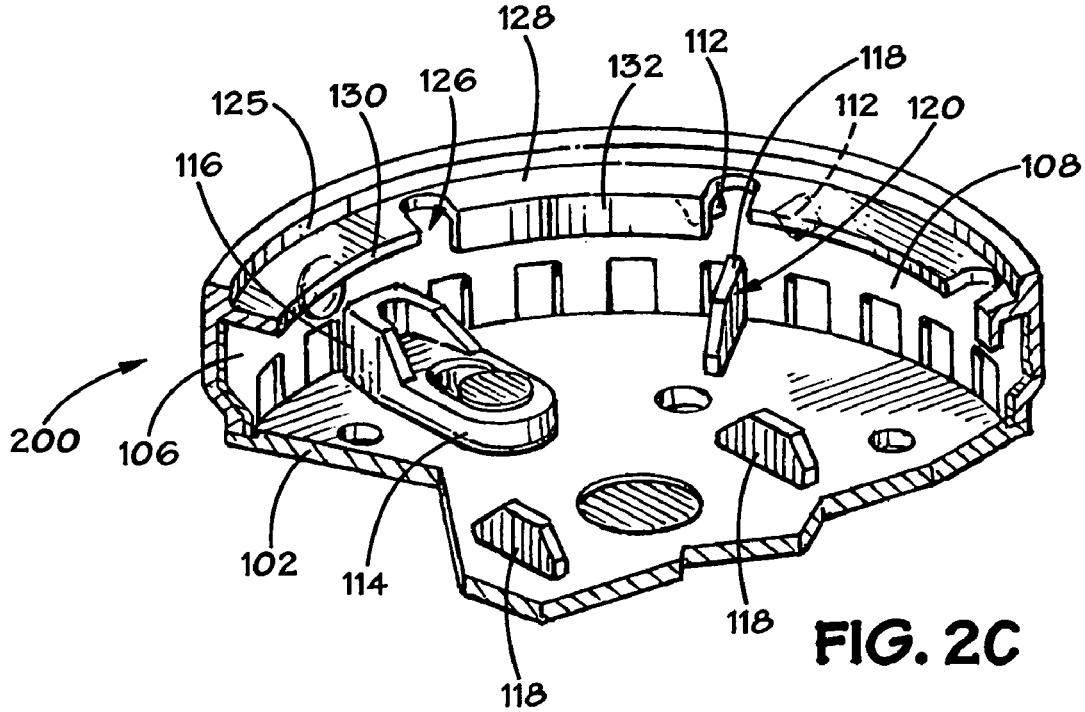
FIGS. 2A-2C illustrate various views of a food reducing mechanism which includes a horizontal toothed ledge working surface having horizontal and vertical teeth.
Figure 2A:
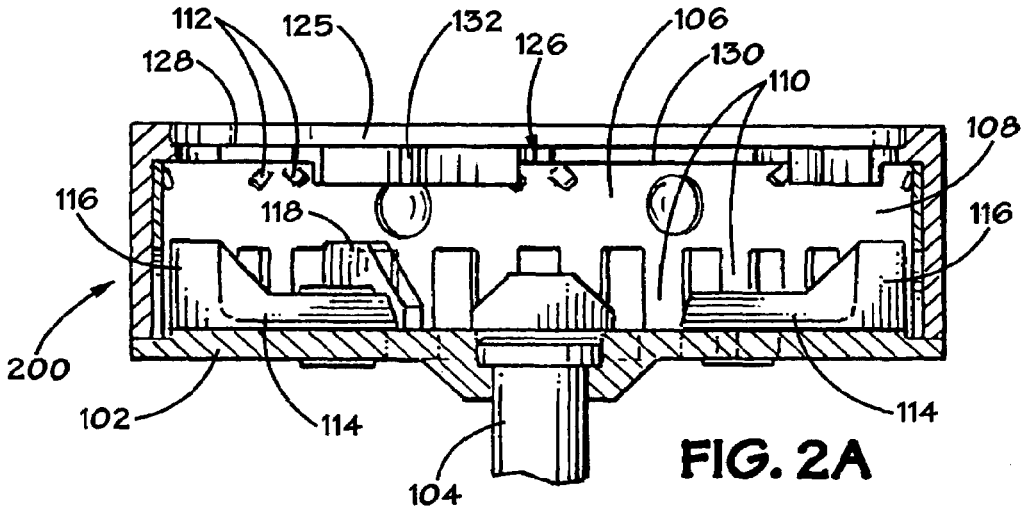
Figure 2B:
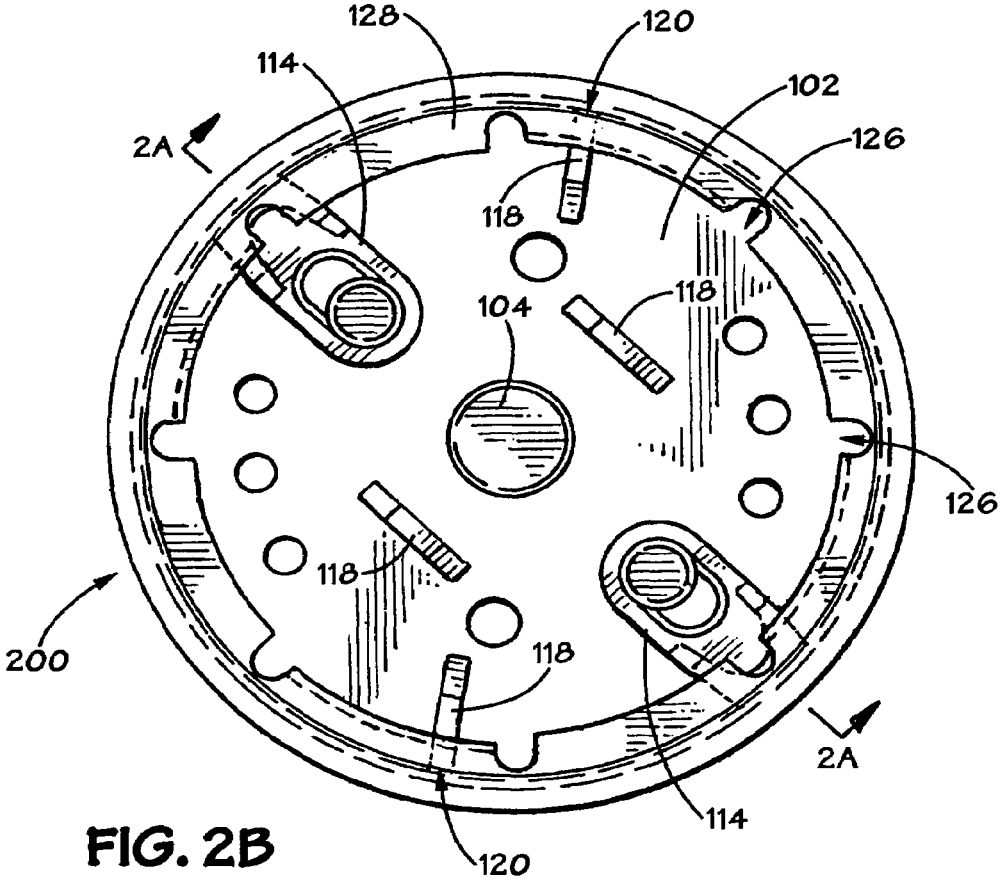

Referring to FIGS. 2A-2C, an embodiment of a reduction mechanism 200 having a horizontal toothed ledge 128 working surface having horizontal and vertical teeth is illustrated. FIG. 2A shows the reduction mechanism 200 in side cross-section, FIG. 2B shows the reduction mechanism 200 in a top view, and FIG. 2C shows the reduction mechanism 200 in a perspective view. This embodiment is similar to the one illustrated in FIGS. 1A and 1B, except this configuration has eight teeth, four of which are horizontally oriented (130) and four of which have a vertically-oriented downward edge (132). The horizontal toothed ledge 128 is positioned directly above the stationary shredder ring 106 in a plastic adaptor 125 that can be directly inserted into the disposal grind chamber.

Both of the embodiments illustrated in FIGS. 1A-1C and 2A-2C have been shown to be effective in completely grinding and discharging fleshy fibrous materials such as those discussed earlier. Of course, one skilled in the art will recognize that these basic approaches are subject to modification. For example, the number of teeth could be changed, or their orientations altered. Additionally, the plastic adaptor 125 need not be necessary if the ring can be affixed to the wall of the grinding chamber in other standard ways.

Figure 3:
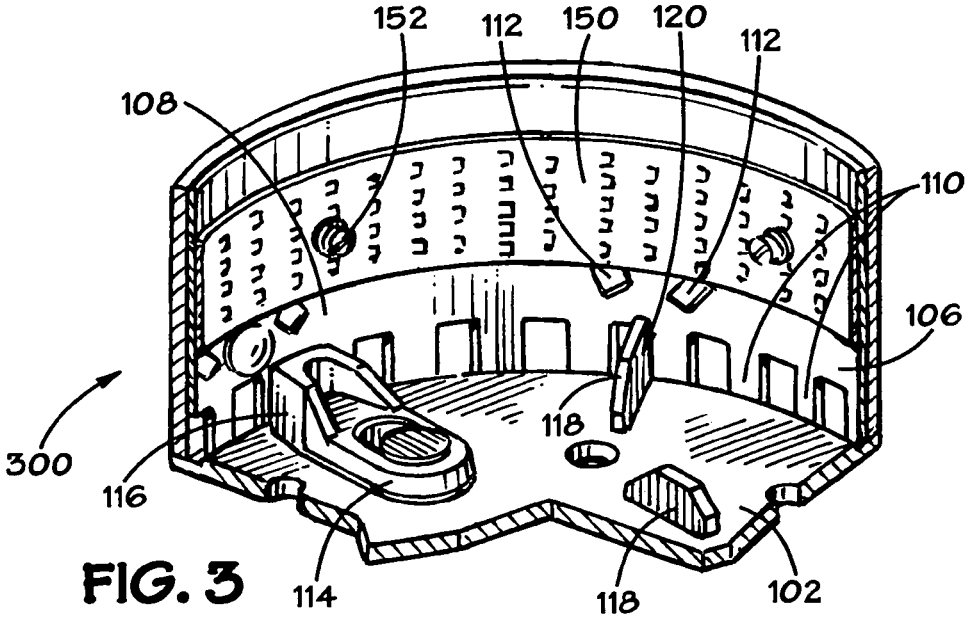
FIG. 3 illustrates a food reducing mechanism which includes a vertical grating or rasping surface.

Referring to FIG. 3, another embodiment of a reduction mechanism 300 having a vertical grating or rasping surface 150 is illustrated. The grating or rasping surface 150 is preferably located against the inner wall of the container body above the stationary shredder ring 106, as illustrated in FIG. 3. As a preferred embodiment, this grating or rasping surface 150 is constructed using a Microplane® flexible woodworker's rasp or a similar equivalent, which is secured to the container body by screws 152. This type of surface in conjunction with the disclosed lugs configurations has been shown to be very effective at completely grinding and discharging large loads of leafy fibrous material.

Figure 4A:
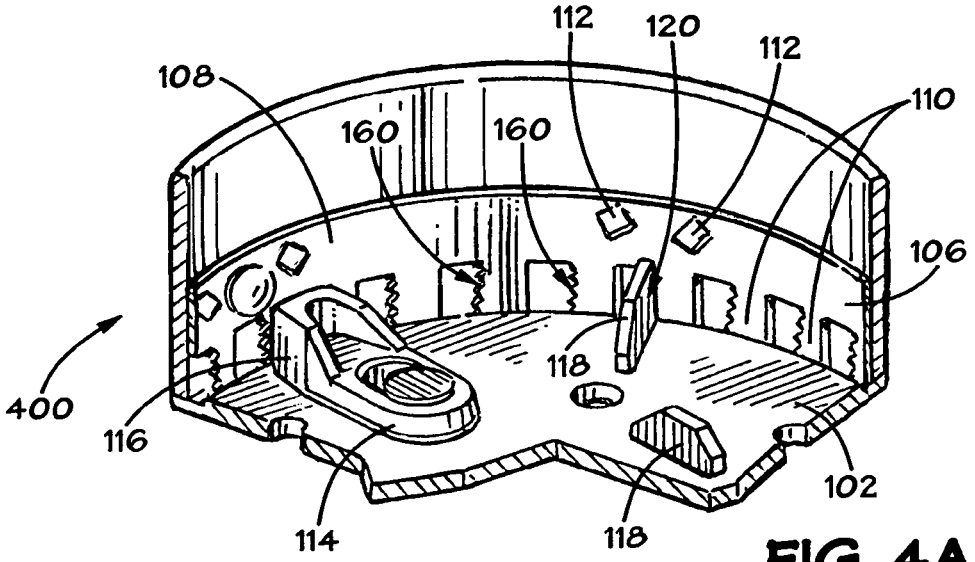
FIGS. 4A-4B illustrate various views of a food reducing mechanism which includes the incorporation of serrated edges on the vertical edge of the teeth in an otherwise standard shredder ring.
Figure 4B:
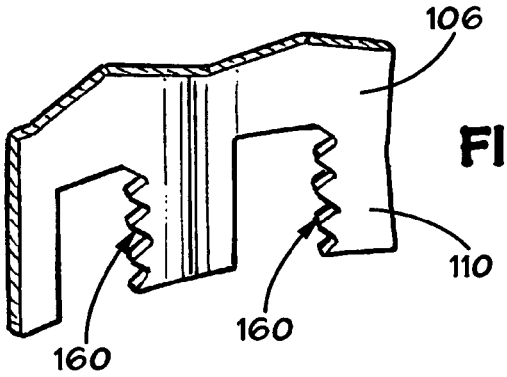

Referring to FIGS. 4A-4B, yet another embodiment of a reduction mechanism 400 having serrated edges 160 on the vertical edge of the teeth 110 in an otherwise standard stationary shredder ring 106 is illustrated. FIG. 4A shows a perspective view of reduction mechanism 400, while FIG. 4B shows a close-up cutaway view of serrated edges 160 on teeth 110. As shown in FIGS. 4A and 4B serrated edges 160 are added to the leading vertical edge of each tooth 110 in the stationary shredder ring 106. This ring design, particularly when used in conjunction with the disclosed grinding lug configurations, has been shown to be effective in completely grinding and discharging large loads of fibrous food wastes such as corn husks.

Of course, these techniques can be logically combined to even further reduce fibrous and/or other food wastes. For example, the serrated edge approach of FIGS. 4A and 4B can be used with any of the approaches disclosed in FIG. 1A-1C, 2A-2C, or 3.

Moreover, the grating or rasping surface approach of FIG. 3 can be used with any of the approaches disclosed in FIG. 1A-1C, 2A-2C, or 4A-4B. The rasping surface can be incorporated into the stationary shredder ring, i.e., teeth can be cut out of the rasping surface to in effect make a rasped shredder ring, or alternatively a rasped surface could appear on the upper edge of the shredder ring where the teeth are not present. The embodiments and approaches disclosed herein can also be used in conjunction with the approaches and embodiments disclosed in the above-incorporated U.S. patent application Ser. No. 10/790,311.

As used herein, the term "plate" is not meant to necessarily refer to a unitary body, or a body that is flat. Furthermore, the term "ring" is not meant to strictly refer to a unitary body having a continuous annular shape, nor a body having constant inner and outer diameters; multiple components may be arranged in a ring shape, and accordingly may still together be considered to constitute a "ring."

The foregoing description of preferred and other embodiments is not intended to limit or restrict the scope or applicability of the inventive concepts contained herein that were conceived by the Applicant. In exchange for disclosing the inventive concepts contained herein, the Applicant desires all patent rights afforded by the appended claims. Therefore, it is intended that the inventive concepts contained herein include all modifications and alterations to the full extent that they come within the scope of the following claims or the equivalents thereof.

What is claimed is:

1. A food waste disposer having a housing and a rotational source, comprising:

a food conveying section of the housing for receiving food waste;

a motor section of the housing having the rotational source; and a grinding section of the housing receiving the food waste from the food conveying section and having a discharge outlet, the grinding section comprising:

a stationary ring disposed in the housing and having an inner wall, the inner wall including a plurality of teeth, a rotatable plate coupled to the rotational source and positioned for rotation relative to the inner wall of the stationary ring, at least one lug attached to the rotatable plate, and a ledge extending around an inner periphery of the housing above the stationary ring and extending inwardly over at least an outer end portion of the lug and providing a working surface directly above the portion of the lug over which the ledge extends that in conjunction with the at least one lug enhances grinding of the food waste.

2. The food waste disposer of claim 1, wherein the at least one lug is a movable lug.

3. The food waste disposer of claim 2, wherein the movable lug has an end for passing adjacent the inner wall of the stationary ring.

4. The food waste disposer of claim 1, wherein the at least one lug is a fixed lug.

5. The food waste disposer of claim 4, wherein the fixed lug has an end for passing adjacent the inner wall of the stationary ring.

6. The food waste disposer of claim 1, wherein the ledge includes a plurality of teeth separated by openings wherein the teeth extend radially inwardly over at least the outer end portion of the at least one lug.

7. The food waste disposer of claim 6, wherein the plurality of teeth are equally spaced apart.

8. The food waste disposer of claim 6, wherein the openings separating the plurality of teeth are substantially semicircular.

9. The food waste disposer of claim 6, wherein at least one of the plurality of teeth has a vertically-oriented downward edge that is spaced apart from the inner wall.

10. The food waste disposer of claim 6, wherein alternating teeth have a vertically-oriented downward edge that is spaced apart from the inner wall.

11. The food waste disposer of claim 1, wherein the ledge is received in an adaptor disposed in the grinding section.

12. The food waste disposer of claim 11 wherein the adaptor is a plastic adaptor.

13. The food waste disposer of claim 1 wherein a bottom of the ledge is flat.

14. The food waste disposer of claim 1 wherein the ledge extends substantially continuously around an entire circumference of the inner periphery of the housing.

15. The food waste disposer of claim 1 wherein the ledge extends continuously around an entire circumference of the inner periphery of the housing.

16. The food waste disposer of claim 1 wherein the ledge is in a plane above any comminuting portion of the lug.

* * * * *

UNITED STATES PATENT AND TRADEMARK OFFICE

CERTIFICATE OF CORRECTION

PATENT NO. : 7,607,599 B2
APPLICATION NO. : 10/859895
DATED : June 3, 2004
INVENTOR(S) : Jara-Almonte et al.

It is certified that error appears in the above-identified patent and that said Letters Patent is hereby corrected as shown below:

Column 1,
Line 28, "modem" should be --modern--.

Signed and Sealed this

Twenty-ninth Day of December, 2009

David J. Kappos

David J. Kappos
*Director of the United States Patent and Trademark Office*